US006619474B2

(12) United States Patent
Montgomery

(10) Patent No.: US 6,619,474 B2
(45) Date of Patent: Sep. 16, 2003

(54) PAINT AND PALETTE CADDY

(76) Inventor: Devida Montgomery, 1708 Emerald, Odessa, TX (US) 79761

( * ) Notice: Subject to any disclaimer, the term of this patent is extended or adjusted under 35 U.S.C. 154(b) by 15 days.

(21) Appl. No.: 09/963,847

(22) Filed: Sep. 25, 2001

(65) Prior Publication Data

US 2003/0057110 A1 Mar. 27, 2003

(51) Int. Cl.[7] ..... B44D 3/00
(52) U.S. Cl. ..... 206/1.9; 206/1.7; 206/1.5
(58) Field of Search ..... 206/1.7, 1.8, 1.9, 206/739, 214, 81, 581, 538, 823, 1.5, 1.81, 1.815, 372

(56) References Cited

U.S. PATENT DOCUMENTS

| | | | | | |
|---|---|---|---|---|---|
| 1,901,861 | A | | 3/1933 | Baker | |
| 2,166,616 | A | * | 7/1939 | Wallace | 206/1.7 |
| 2,221,191 | A | | 11/1940 | James | |
| 2,424,898 | A | * | 7/1947 | Pressman | 206/1.8 |
| 3,278,007 | A | * | 10/1966 | Weber | 206/1.8 |
| 3,760,973 | A | | 9/1973 | Canning et al. | |
| 3,945,490 | A | * | 3/1976 | Thompson | 206/1.7 |
| 4,372,630 | A | * | 2/1983 | Fuhri | 206/1.7 |
| 4,690,271 | A | * | 9/1987 | Zak | 206/1.7 |
| 4,765,457 | A | * | 8/1988 | Rayhle | 206/1.8 |

* cited by examiner

*Primary Examiner*—Mickey Yu
*Assistant Examiner*—G. Pickett
(74) *Attorney, Agent, or Firm*—Milburn & Peterson, P.C.; Robert C. Peterson

(57) ABSTRACT

A paint and palette caddy in the form of a case, which includes a hinged top with closures and a pull out drawer, which may be latched; under the top is a rack or tray having a number of sockets for holding paint cups by friction or indexing means and a number of slots for holding the paint cup caps; the upper area of the paint cups are slightly larger in dimension than the sockets; the drawer, when extended, provides a paint palette surface that may be covered with a disposable sheet so that the palette surface remains free from paint; the removable cups are sealed with an appropriate cap to provide an airtight seal and eliminate as much air space as possible between the surface of the paint and the cap; the cups may be removed from the case and stored in a freezer to preserve the paint for extended periods.

6 Claims, 2 Drawing Sheets

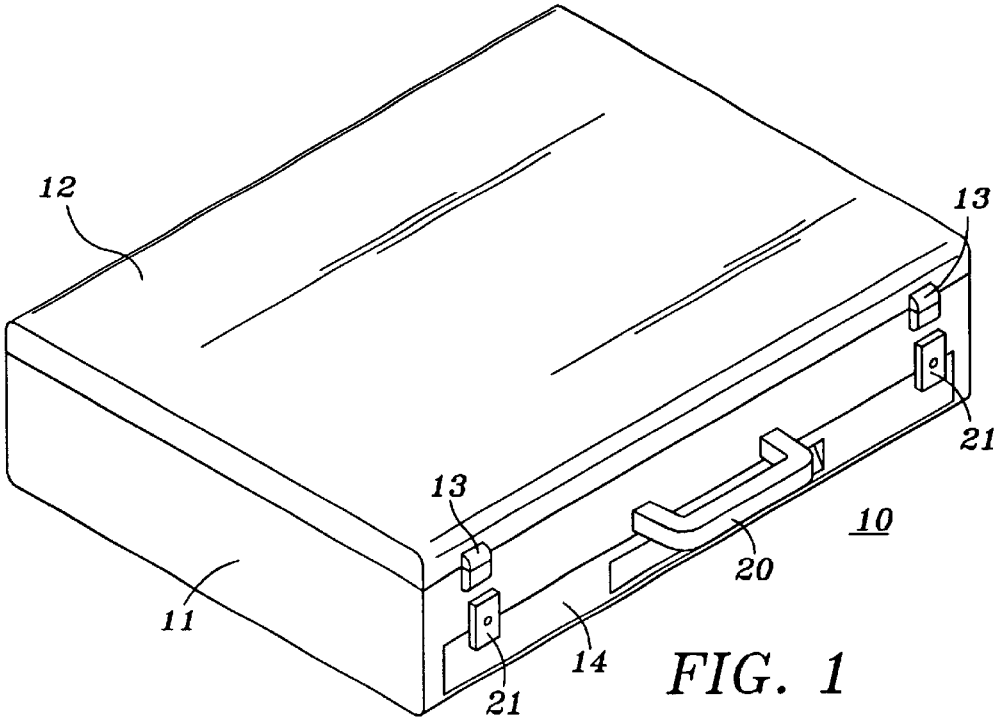
FIG. 1
FIG. 4
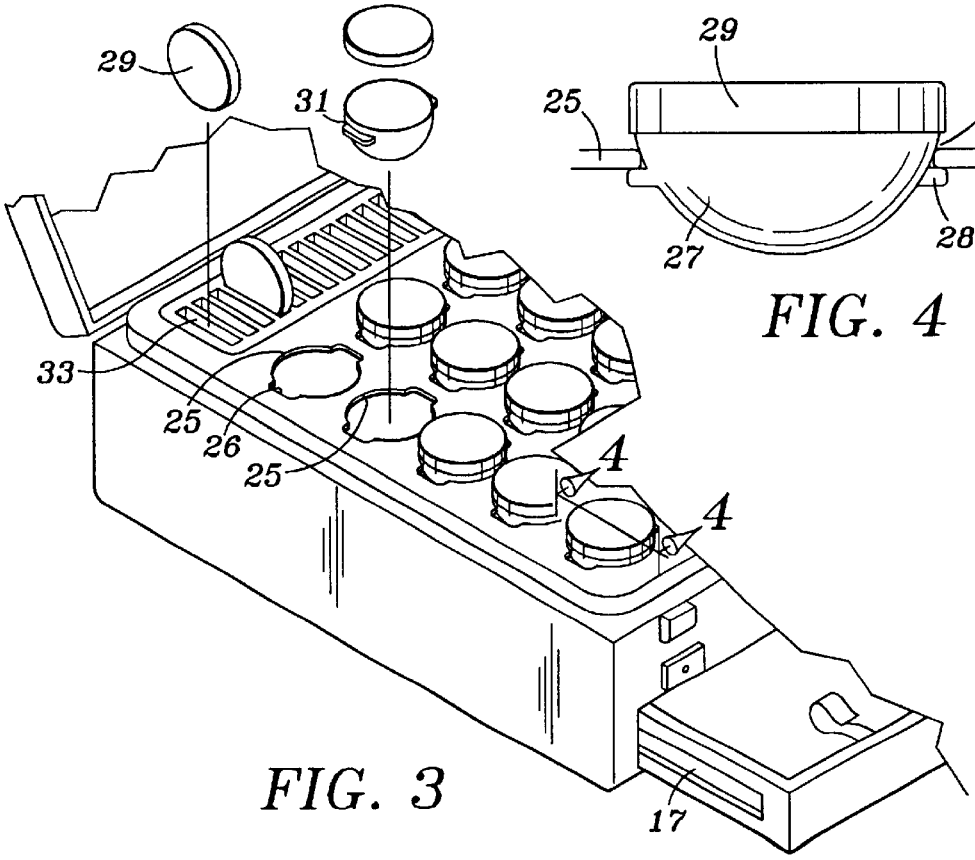
FIG. 3

PAINT AND PALETTE CADDY

BACKGROUND OF THE INVENTION

1. Field

The present invention relates to carriers for artists and more particularly to a paint and palette caddy for organizing, storing and carrying paints and palette with paint brushes in a compact case for use in the field or studio.

2. State of the Art

In the past, various paint boxes for watercolors and oil paints have been proposed for carrying the paints and the paintbrushes. U.S. Pat. No. 2,221,191 to James describes a watercolor paint box with various open color or paint pans adapted to be snapped in and out of the tray, however, the color pans expose the paint to air and do not have individual lids. The boxes permit storage of paintbrushes and provide open mixing pans.

U.S. Pat. No. 3,760,973 describes a resealable container having numerous fixed receptacles for storage of material, such as paint, and includes an integral cover having depressions in the form of a matrix which fit into and seal the open ends of the receptacles, thus it provides one integral unit, with a number of receptacles. However, once the integral cover is removed all the paint is exposed. In an alternate aspect hinged closures or lids for the individual receptacles fit into the receptacles with an interference fit to form a seal. In another arrangement the lids are separated from a matrix and are individually sealed away from the receptacles. The receptacles are integral with the base and cannot be replaced or treated separately.

In situations where the stored material must be stared in containers which are resealable after each use as in the case of paint sets in which the paint is stored in liquid form and is subject to drying out or other deterioration, if not properly protected, the containers filled with such paint should be sealed air-tight during transportation and storage and should be reclosable, maintaining an air-tight seal after each use of the paint.

One type of storage container which has found recent use in conjunction with perishable materials such as paints stored in liquid form utilizes a base of pressed board or other inexpensive construction having holes into which vacuum formed cups are inserted to form receptacles for paints. Each cup is fitted with a separate cap.

Although such containers, even if somewhat effective to reduce deterioration of the paints or other contents, they lack any desired features artists look for which include quick setup of easels and palettes with the full array of colors of oils or other paints readily available for use. Such containers fail to provide brushes, brush storage and palette in one accessible case.

Setting up a painting area takes time and thought when getting ready to paint. It is important for the artist to have the paints, palette and canvas relatively close together for ease of movement from the palette to canvas, thus saving time when it comes to painting. Ease of setup and rapid cleanup which are desirable features, as well as, saving of mixed color oils or other paints are lacking in the prior art.

SUMMARY OF THE INVENTION

It is an object of the present invention to provide a paint and palette caddy having a case including a hinged top and a pull out tray or drawer. The case includes a carrier or tray, which may be secured to the case and provides numerous openings for securing a plurality of paint cups with snug fitting lids, which seat in the opening and are detachably secured. The carrier also includes multiplicity of slots which conveniently store the paint cup lids when the paint is being used. The slide out drawer provides the palette for mixing paints.

It is another object of the invention to provide a compact paint and palette caddy, which provides numerous paint cups, which may be removed and the cups placed in a freezer to store the paint without significant deterioration, thus permitting storage of the paint overnight or for a period of time and when the artist is ready to paint, the paint cups are then ready and placed in the caddy.

A further purpose of the present invention is to provide a compact carrier for paint, which includes a tray or rack holder for paint cups and lids, and a pull out drawer, which acts as the palette and may be covered with paper held in place by clips, to provide a throw away work surface cover for the palette, such that the palette does not incur paint stains or require extensive cleaning with each use.

Another object of the paint and palette caddy is to provide in a compact case a paint organizer with a paint palette, paint cups and a paint keeper/storage unit for oil, acrylic, or watercolor paints and also provides brush storage.

Another object of the invention is to provide a convenient case for carrying and storing artists' paints and brushes, as well as, having a working palette ready to setup in the field or studio and for maintaining numerous covered paint cups that may be removed, placed in a freezer bag and stored overnight or longer until needed.

A further object of the invention is to provide an artists' organizer in which the paints, palette, paint cups and brushes are arranged in an orderly fashion and quickly accessed to setup for use and cleanup after use.

BRIEF DESCRIPTION OF THE DRAWINGS

FIG. 1 is a perspective view of the paint and palette caddy ready to be transported.

FIG. 3 is a partially exploded perspective view illustrating the paint cup holder and lid holder.

FIG. 4 is a sectional view taken along the lines 4—4 of FIG. 3.

DETAILED DESCRIPTION OF THE PREFERRED EMBODIMENT

Figure 2:
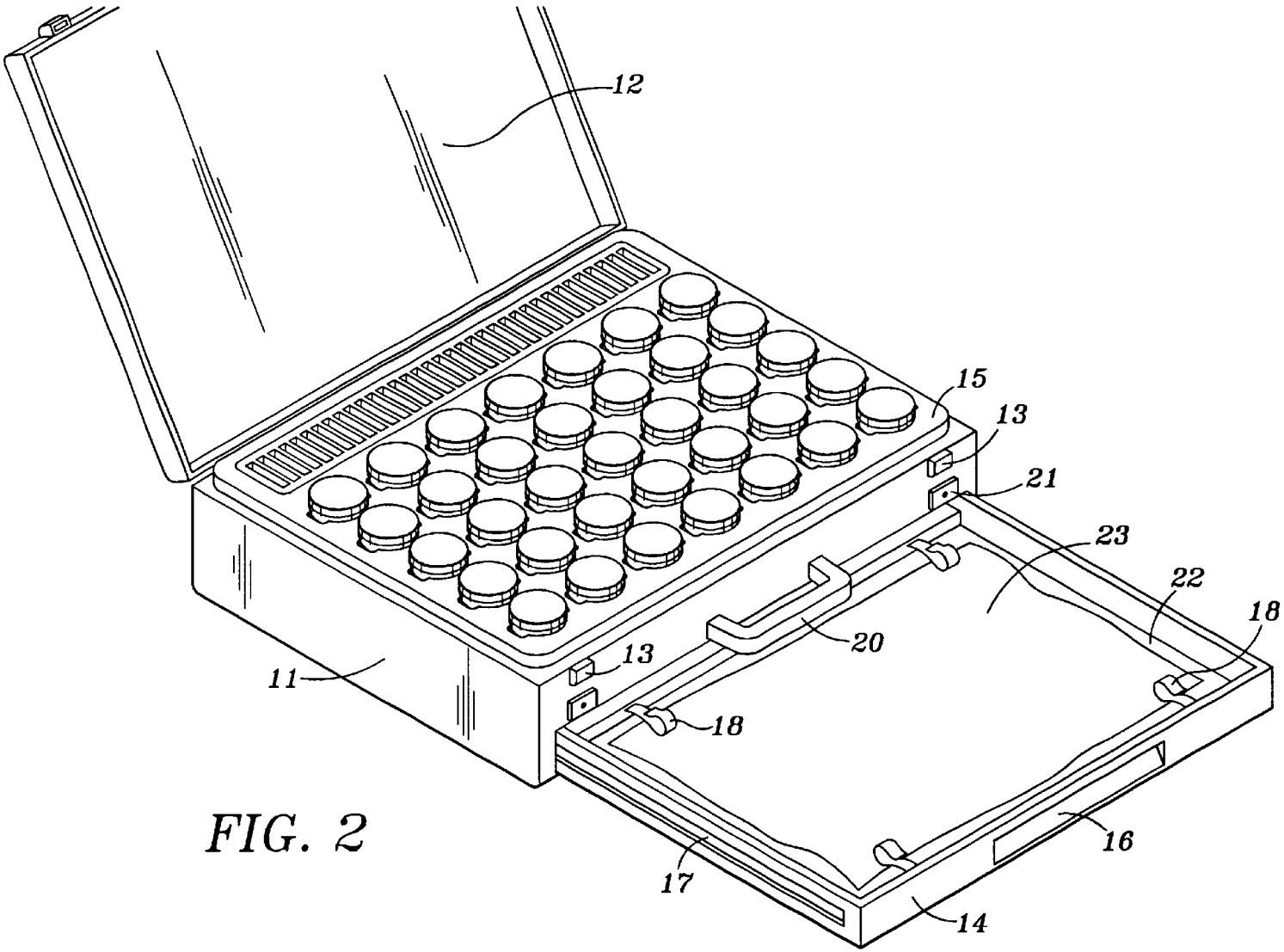
FIG. 2 is a perspective view of the paint and palette caddy opened in preparation for use.

Referring to FIGS. 1–4, paint and palette caddy 10 includes case 11, having top 12 and drawer or palette 14, and a carrying handle 20. Case 11 includes tray or rack 15. Drawer 14 includes grip 16 with track 17 and spring clips 18. Case 11 has a pair of snap-locks 13 and includes handle 20. When drawer 14 is in a closed position as illustrated in FIG. 1, snap-locks 13 secure top 12 closed and latch 21 retains drawer 14 from being withdrawn from case 11. To open drawer 14, latch 21 is twisted to a horizontal position (FIG. 2) and frees drawer 14 to slide out along track 17. Spring clip 18 are provided to secure replaceable sheets 23 of paper or material to provide a replaceable work surface for palette surface 22 of drawer 14. The paper, when used, is held on surface 22 of palette 14, by spring clips 18.

Tray or rack 15 has sockets or openings 25 preferrably with notches or recesses 26. Paint cup 27 has a pair of lips 28 and lids or caps 29. Paint cups 27 are seated in sockets 25 with lips 28 oriented in notches 26 and rotate so that lips 28 extend beneath tray or rack 15 to hold paint cups 27 seated in sockets 25 with lips 28 of paint cups 27 beneath tray or rack 15 and rims 31 of paint cups 27 above tray or rack 15 and the rim 31 of paint cup 27. Tray 15 has a series of retention slots 33 for holding lids 29 when removed from paint cups 27 (see FIG. 3). Alternatively, paint cups 27 may be retained in rack 15 by an interference fit in openings 25.

In the preferred embodiment case 11 is approximately 12 inches wide by 16 inches long with a depth of 3½ inches. Tray or rack 15 accommodates 35 one ounce cups with lids 29 in openings 25 with slots 33 for storing lids 29 when removed from cups 27. Cups 27 are 1½ inches in diameter and 1¼ inches deep in the center.

The versatility of caddy 10 and the organizing method will be apparent from the following. Caddy 10 is placed on a counter or suitable support surface and top 12 and drawer 14 are opened. Paint cups 27 may be removed from or retained in rack 15 and suitable amounts of oil paint are placed in paint cups 27, which hold approximately one (1) ounce of paint. In addition to the standard colors of oil paint, a blend of colors may be prepared. First, cover sheet 23 is positioned on palette surface 22 and held in place by clips 18. Next a suitable amount of oil paints to be blended are placed on cover sheet 23 and mixed with a palette knife to provide the desired color blend of oil paint. The palette knife is then used to transfer the blended oil paint into paint cup 27. If the paint is to be used right away, then paint cups 27 with caps 29 are placed in sockets or openings 25 and the process is repeated for as many blends of oil paints as desired. Case 11, holds as many as 35 different colors and blends of oil paints. Once paint cups 27 have been secured in rack 15 and cover sheet 23 discarded, caddy 10 may be closed and carried to the artist's studio or field location for painting. Top 12 would be raised and drawer 14 pulled out and artist is ready to setup the canvas. Remove lids 29 and place in slots 33. Clean cover sheet 23 is placed on palette surface 22 and the artist is ready to mix additional paints as required by the scene to be captured on the canvas.

Alternatively, if the artist has mixed all the paints and placed them in paint cups 27 with lids 29, but will not be painting right away, paint cups 27 may be removed from sockets 25 and placed in a freezer for storage until the artist is ready to use the paints. At which time, paints are removed from the freezer and placed back in rack 15 of caddy 10. Before removing caps 29 from paint cups 27 just removed from the freezer, the artist should wait about two (2) to three (3) minutes for the paints to warm and then lids 29 can be removed. In positioning paint cups 27 in rack 15, the artist may selectively determine the arrangement of the different colors of paint in a convenient order, which is well know to the artist. Likewise, paint cup lids 29 can be marked with indicia to assist the artist in arranging paint cups 27 in rack 15.

These and other features and advantages of this invention will be appreciated and while the invention has been particularly shown and described with reference to the preferred embodiment it should be understood that various changes in forms and details may be made without departing from the scope of the invention, which is limited only by the appended claims.

What is claimed is:

1. An artist's caddy for organizing paint cups and lids and paint palette comprising:

(a) a case having a top movable between a raised and closed position and a slide out drawer movable between an open and a closed position;

(b) a rack within said case exposed when the top is in the raised position, said rack having a series of openings and a series of slots;

(c) a series of paint cups and lids for each of the paint cups, the series of paint cups being releasably retained in the series of openings and the paint cup lids, when removed from the paint cups, being releasably retained in the series of slots;

(d) said drawer acting as a palette in the open position, and providing storage; and (e) said top retained in the lowered position and said drawer retained in the closed position for carrying.

2. The artist caddy of claim 1, wherein the top is hinged and has a pair of closures for maintaining the top in the closed position for carrying.

3. The artist caddy of claim 1, wherein the drawer has fasteners for holding a discardable cover sheet to the palette.

4. The artist caddy of claim 1, wherein the openings form sockets to releasably retain the paint cups.

5. The artist caddy of claim 4, wherein each paint cup includes a rim and has at least one tab below the rim.

6. The artist caddy of claim 5, wherein each socket has at least one notch to seat the tab of the paint cup wherein the paint cup is rotated in the socket for retention in the rack.

* * * * *